United States Patent [19]

Yano et al.

[11] 4,029,222

[45] June 14, 1977

[54] APPARATUS FOR LOADING SHEET MATERIAL ON A PLURALITY OF SHELVES ON A BOOK TRUCK

[75] Inventors: Eizi Yano, Higashimurayama; Shunjiro Ohkawa, Iruma; Tadaaki Komatsu, Akigawa; Masami Adachi, Higashimurayama, all of Japan

[73] Assignee: Bridgestone Tire Company Limited, Tokyo, Japan

[22] Filed: Apr. 21, 1975

[21] Appl. No.: 570,163

[30] Foreign Application Priority Data

| | | |
|---|---|---|
| Apr. 30, 1974 | Japan | 49-49195 |
| Apr. 30, 1974 | Japan | 49-49196 |
| June 21, 1974 | Japan | 49-71680 |

[52] U.S. Cl. ..... 214/41 R; 214/164 A

[51] Int. Cl.[2] ..... B65G 67/04

[58] Field of Search ..... 214/16 B, 16.4 R, 16.4 A, 214/6 F, 16.6, 41, 1 R; 198/32, 35

[56] References Cited

UNITED STATES PATENTS

| | | | |
|---|---|---|---|
| 3,562,071 | 2/1971 | Rockefeller | 198/35 X |
| 3,596,747 | 8/1971 | Irving et al. | 198/35 |
| 3,725,183 | 4/1973 | Brooklyser et al. | 198/35 X |
| 3,731,823 | 5/1973 | Goth | 214/6 F |
| 3,836,022 | 9/1974 | Ims | 214/41 |
| 3,920,134 | 11/1975 | Scarpa et al. | 198/35 X |

*Primary Examiner*—Albert J. Makay
*Assistant Examiner*—R. B. Johnson

[57] ABSTRACT

In order to automatically load sheet materials on a plurality of shelves piled on a book truck, an apparatus comprises a loading mechanism provided adjacent to the book truck for loading predetermined numbers of the sheet material on the shelves of the book truck, a waiting mechanism provided adjacent to an end of the loading mechanism remote from the book truck for conveying the sheet materials onto the loading mechanism when the loading mechanism has no sheet material thereon and for holding the sheet materials thereon when the loading mechanism has the sheet materials thereon, and a lining-up mechanism provided adjacent to an end of the waiting mechanism remote from the loading mechanism for lining up the sheet materials and conveying the sheet materials onto the waiting mechanism.

11 Claims, 23 Drawing Figures

1
9
T
9
2
30
29
3
46
5
52
4
67
67

FIG. 9
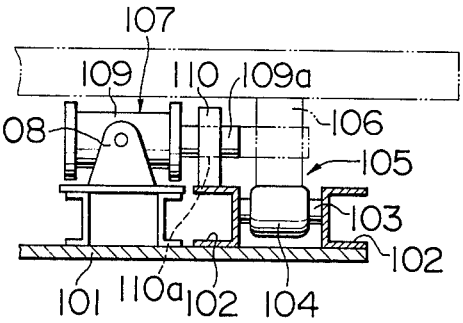
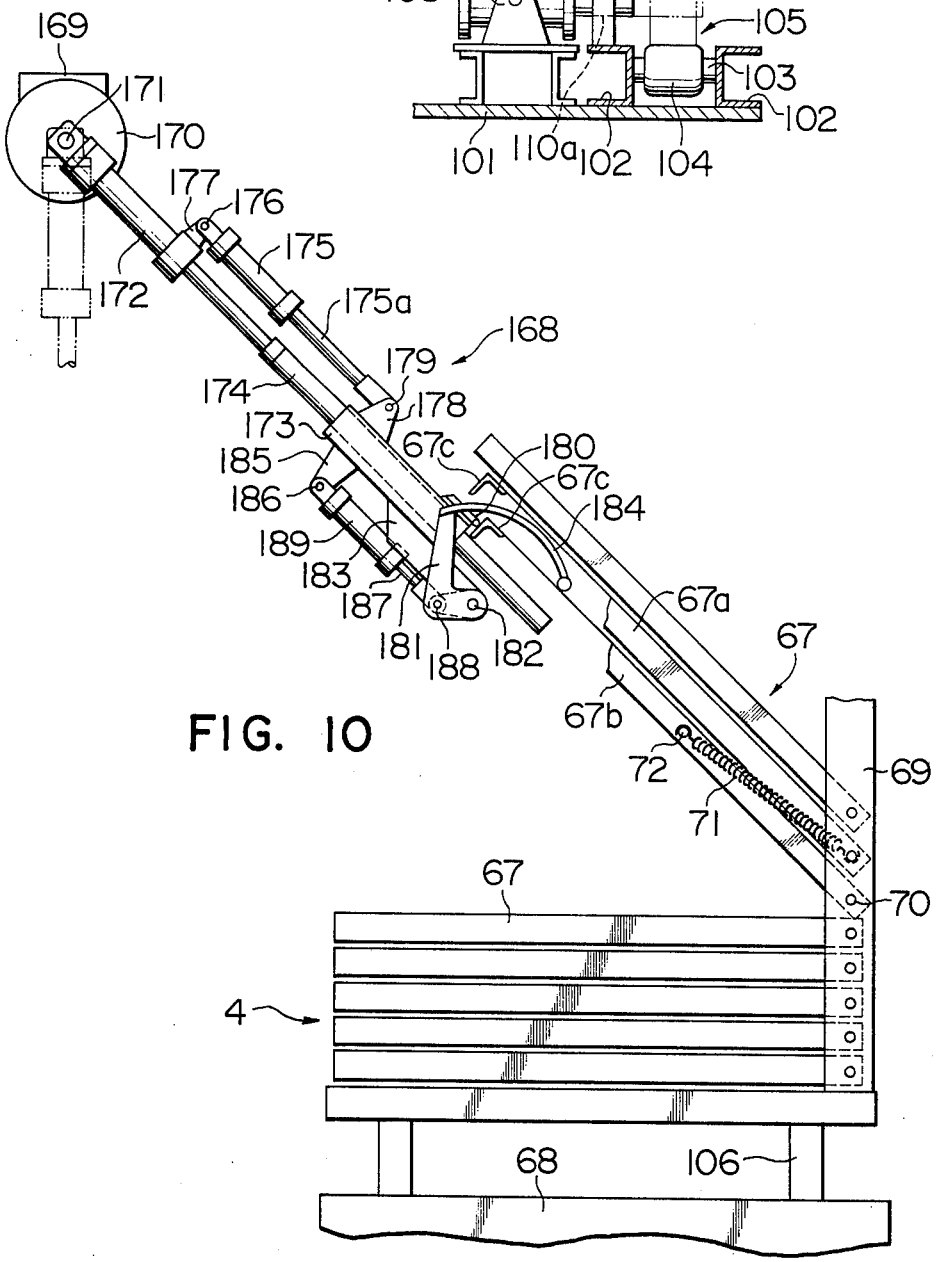
FIG. 10

APPARATUS FOR LOADING SHEET MATERIAL ON A PLURALITY OF SHELVES ON A BOOK TRUCK

FIELD OF THE INVENTION

This invention relates to an apparatus for automatically loading sheet materials on a plurality of shelves piled on a book truck and, more particularly, to an apparatus for automatically loading a plurality of tire tread members on each of the shelves on the book truck.

BACKGROUND

One type of conventional book trucks has swingably mounted thereon a plurality of shelves each of which is resiliently held in a slanted condition and adapted to swing down to a horizontal position.

In order to load the continuously conveyed tire tread members onto such shelves of the book truck, an operator heretofore performed such an operation as lining up and piling the tread members on a horizontal uppermost shelf and then swinging down an immediately upper slanted shelf to be kept in a horizontal condition for repeating the same operation as such. The loading operations were required to be repeated for all the shelves, which were simple and but time consuming, resulting in laborious and repetitive work for the operator. It was thus impossible for the operator to continuously perform such operations in view of his physical and mental aspects so that the loading operations were alternately carried out by two or more operators. On the other hand, the tread member was apt to be deformed during handling by the operator with the result that a finished tire was undersirably affected as regards such tire characteristics as unbalance property, uniformity property and the like.

SUMMARY OF THE INVENTION

It is therefore a primary object of the present invention to provide an apparatus for loading sheet materials on a plurality of shelves on a book truck in an automated fashion which will provide increased production efficiency and contribute to elimination of laborious operations.

It is another object of the present invention to enhance tire characteristics for a finished tire by preventing deformation of a tread member during its handling.

These and other objects of the present invention may be achieved by providing an apparatus, for loading sheet materials on a plurality of shelves piled on a book truck, which comprises a loading mechanism provided adjacent to the book truck for loading predetermined numbers of sheet material on the shelves of the book truck, a waiting mechanism provided adjacent to an end of the loading mechanism remote from the book truck for conveying the sheet materials onto the loading mechanism when the loading mechanism has no sheet materials thereon and for holding the sheet materials thereon when the loading mechanism has the sheet materials thereon, and a lining-up mechanism provided adjacent to an end of the waiting mechanism remote from the loading mechanism for lining up the sheet materials and conveying the sheet materials onto the waiting mechanism.

The apparatus may further comprise a turning mechanism provided adjacent to an end of the lining-up mechanism remote from the waiting mechanism for turning the sheet materials to be received on the lining-up mechanism. The shelves may be pivotally mounted on the book truck and have respective projections projected outwardly to be steppedly arranged, and the apparatus may further comprise holding means for resiliently holding the shelves under slanted conditions, a swing mechanism disposed oppositely to and in the vicinity of the projections of the shelves for swinging down the shelves through the projections against the holding means to horizontal conditions from the slanted conditions, a travelling mechanism for travelling the swing mechanism along the projections of the shelves to dispose the swing mechanism opposite to each of the projections of the shelves, and a lifter mechanism for lowering the shelves on the book truck by a pitch corresponding to the thickness of the shelf at a time.

The shelves may be pivotally mounted on the book truck, and the apparatus may further comprise holding means for resiliently holding the shelves under slanted conditions, a swing mechanism disposed oppositely to and in the vicinity of the outer edges of the shelves for detecting the outer edges of the shelves and swinging down the shelves against the holding means to horizontal conditions from the slanted conditions, and a lifter mechanism for lowering the shelves on the book truck by a pitch corresponding to the thickness of the shelf at a time.

BRIEF DESCRIPTION OF THE DRAWING

Further features and advantages of the apparatus in accordance with the present invention will become more apparent from the following description taken in conjunction with the accompanying drawings, in which:

FIG. 9 is an enlarged side elevational view of truck stop means provided on the truck conveyor mechanism illustrated in FIGS. 7 and 8;

FIG. 10 is an enlarged side elevational view of another embodiment of a swing mechanism in place of the swing mechanism illustrated in FIGS. 5 and 6.

DETAILED DESCRIPTION

Figure 1:
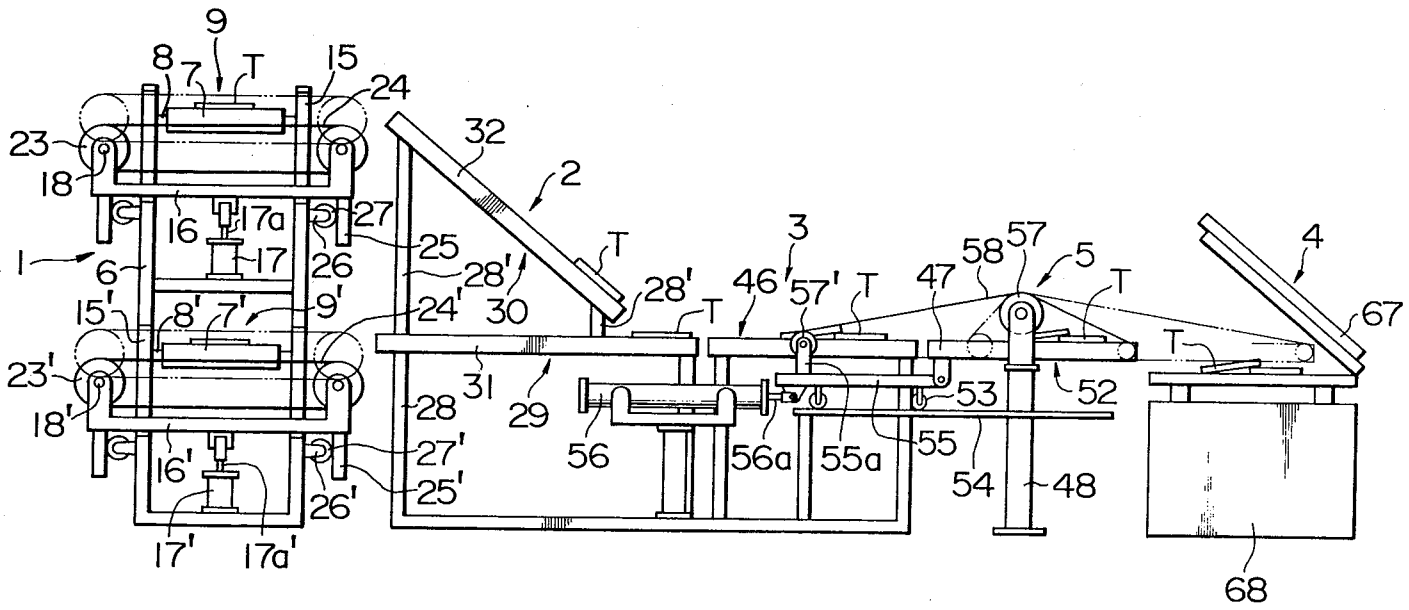
FIG. 1 is a side elevational view of a preferred embodiment of the apparatus in accordance with the present invention showing a turning mechanism, a lining-up mechanism, a waiting mechanism, a loading mechanism and a book truck.

While the sheet material handled in the embodiment of the apparatus according to the present invention will hereinafter be exemplified by a tread member, it should be borne in mind that such is merely by way of example and, thus, the sheet material may include any sheet materials other then the tread member.

Reference will now be made to the drawings, especially to FIGS. 1 and 2. The apparatus embodying the present invention is shown comprising a turning mechanism, generally designated at 1, which functions to turn the conveyance direction of the tread members T at substantially right angles. Forwardly of and adjacent to the turning mechanism 1 is provided a lining-up up mechanism, generally designated at 2, which functions to overlap and line up the tread members T which are transferred onto the lining-up mechanism by the turning mechanism 1. Forwardly of and adjacent to the lining-up up mechanism 2 is provided a waiting mechanism, generally designated at 3, which functions to hold the tread members T transferred onto the waiting mechanism 3 by the lining-up mechanism 2 in predetermined time intervals or to convey directly the tread members T onto the forward process. Forwardly of and adjacent to the waiting mechanism 3 is provided a loading mechanism, generally designated at 5, which functions to load onto a book truck 4 the tread members T which are transferred onto the loading mechanism 5 by the waiting mechanism 3.

The turning mechanism 1 comprises first turning means, generally shown at 9 and second turning means, generally shown at 9'. The second turning means 9 includes a multiplicity of parallel spaced rollers 7 which are rotatably carried on a fixed frame 6 through their respective shafts 8. The shaft 8 of the outermost roller 7 is adapted to be rotated by an electric motor 10 through a sprocket wheel 11 secured on an output shaft of the electric motor 10, a sprocket wheel 13 secured on the shaft 8 of outermost roller 7 and an endless chain 12 passed on these two sprocket wheels 11 and 13, while the remaining rollers 7 are adapted to be rotated by an endless chain 14 passed on sprocket wheels which are secured on the respective shafts 8 of the rollers 7 but are not shown in the drawings. The second turning means 9 is always driven by the electric motor 10 so that the tread member T is conveyed at substantially right angles relative to the axes of the rollers 7 when the tread member T is transferred onto the second turning means 9 from a previous process, not shown in the drawings. On the fixed frame 6 between each pair of rollers 7 is formed a vertically extending closed slot 15 which slidably receives outwardly projected both end portions of a movable frame 16. A fluid-operated cylinder 17 is vertically fixedly mounted on the fixed frame 6 and has a piston rod 17*a* the upper end of which is connected to the lower wall of the movable frame 16 so that when the fluid-operated cylinder 17 is actuated to project upwardly or retract downwardly the piston rod 17*a*, the movable frame 16 is caused to vertically move upwardly or downwardly. The movable frame 16 is normally maintained to be lowered as shown in solid lines in the drawings with the piston rod 17*a* of the cylinder 17 being retracted downwardly. Both end portions of the movable frame 16 are curved or bent upwardly and rotatably carry thereon a pair of rotary shafts 18 one of which is adapted to be rotated by a reversible electric motor 19 through a sprocket wheel 20 secured on an output shaft of the motor 19, a sprocket wheel 22 secured on the rotary shaft 18, and an endless chain 21 passed on these two sprocket wheels 20 and 22. A pair of sprocket wheels 23 are rigidly mounted on the respective rotary shafts 18 so as to be disposed between each pair of the rollers 7 on the fixed frame 6 and have an endless chain 24 passed thereon. When the tread member T is conveyed by the rollers 7 and the fluid-operated cylinder 17 is actuated to cause its piston rod 17*a* to be projected upwardly, the upper surfaces of the endless chains 24' is moved beyond the upper surfaces of rollers 7 as shown in phantom lines so that the tread member T is distributed toward either side of the first conveyor means at substantially right angles by alternately rotating the reversible electric motor 19. A good tread member T can thus be conveyed to the lining mechanism 2, while an inferior tread member T can also be distributed or discharged from the second conveyor means 9 in an opposite direction to the lining-up mechanism 2 by reversing rotation of the electric motor 19 without stopping the turning mechanism 1 even if it is conveyed by the rollers 7 together with good tread members T. To the both lower portions of the movable frame 16 are fixed a pair of downwardly extending racks 25 which are adapted to be meshed with a pair of pinion gears 27, respectively, which are rotatably supported by the outer end portions of brackets 26 rigidly connected to the outer walls of the fixed frame 6.

The first turning means 9' is disposed immediately below the second turning means 9 and their constructions are substantially identical to each other so that there will not be explained hereinafter the parts of the first turning means 9' corresponding to the parts of the second turning means 9 which are, however, shown with a prime. The second and first turning means 9 and 9' are thus provided at the upper and lower portions, respectively, of the fixed frame 6 so that the tread members T fed from the previous processes are conveyed or transferred onto the lining-up mechanism 2 by upwardly moving the movable frames 16 and 16' and transferring the tread members T from the rollers 7 and 7' to the endless chains 24 and 24' at substantially right angles. The movable frames 16 and 16' are lowered by the action of the fluid-operated cylinders 17 and 17' immediately after the above turning operation of the turning mechanism 1.

The lining-up mechanism 2 is disposed adjacent to the turning mechanism 1 to receive the tread members T conveyed by the turning mechanism 1. The lining-up mechanism 2 comprises a horizontal first conveyor means, generally-designated at 29, mounted on a fixed frame 28 positioned in the neighborhood of the first turning means 9' of the turning mechanism 1 and a slanted second conveyor means, generally designated at 30, which has an upper end or rearmost end oppositely disposed to the second turning means 9 of the turning mechanism 1 and a lower end or foremost end positioned in close proximity to the surface of the first conveyor means 29. The second conveyor means 30 is shown comprising a plurality of parallel spaced rotary shafts 33 which are rotatably carried by a pair of parallel spaced frames 32 and which are disposed at substantially right angles relative to the conveyance direction of the tread member T and a multiplicity of generally circular disc members 34 which are rigidly mounted on each of the rotary shafts 33 parallel to and in spaced relation with each other. An endless chain 36 is passed on sprocket wheels each of which is rigidly mounted on the end portion of each rotary shaft 33 but not shown in the drawings. The outermost rotary shaft 33 of the second conveyor means 30 is rotated by an electric motor 42 through a sprocket wheel 43 secured on an output shaft of the electric motor 42, a sprocket wheel 45 rigidly mounted on an outwardly extended portion of the outermost rotary shaft 33 and an endless chain 44 passed on these two sprocket wheels 43 and 45 so that all the rotary shafts 33 and the disc members 34 are driven in rotation to convey the tread member T. The first conveyor means 29 is shown comprising a pair of parallel spaced frames 31 which are mounted on the fixed frame 28 to support the frames 32 of the second conveyor means 30 through upstanding posts 28'. The plan view of the first conveyor means 29 is not appeared in FIG. 2, however, its construction is substantially identical to that of the second conveyor means 30 which have been explained above. The construction of the first conveyor means 29 will thus not be explained hereinafter with the exception that an outermost rotary shaft 33 of the first conveyor means 29 is rotated by an electric motor 37 through a sprocket wheel 38 rigidly mounted on an output shaft of the electric motor 37, an endless chain 39 passed on the sprocket wheel 38, and an electromagnetic clutch brake 41 having an input shaft carrying thereon a sproket wheel 40 passed on with the endless chain 39 and an output shaft fixedly connected to the outermost rotary shaft 33. The tread member T on the second conveyor means 30 is thus fed onto and overlapped on the tread member T on the first conveyor means 29 at the forward end portion of the second conveyor means 30 so that the tread members T are lined up on the first conveyor means 29 and conveyed to the next waiting mechanism 3.

The waiting mechanism is disposed adjacent to and forwardly of the lining-up mechanism 2 is shown comprising waiting conveyor means 46 which is of substantially the same construction as those of the first and second conveyor means 29 and 30 of the lining-up mechanism 2. The waiting conveyor means 46 is driven similarly to the first conveyor means 29 of the lining-up mechanism 2 in such a manner that an outermost rotary shaft 33 is rotated by an electric motor 37 through a sprocket wheel 38 rigidly mounted on an output shaft of the electric motor 37, an endless chain 39 passed on the sprocket wheel 38, and an electromagnetic clutch brake 41 having an input shaft carrying thereon a sprocket wheel 40 passed on with the endless chain 39 and an output shaft fixedly connected to the outermost rotary shaft 33. The waiting mechanism 3 is adapted to hold the tread member T in predetermined time intervals when the tread members T are present on the loading mechanism 5, and on the other hand, to directly convey the tread members T onto the loading mechanism 5 when any tread member T is not present on the loading mechanism 5 so that the capacity of handling the tread members T will be preferably maintained between the lining-up mechanism 2 and the loading mechanism 5.

The loading mechanism 5 is shown comprising a fixed frame 48 and a movable frame 47 which is adapted to move toward and away from the waiting conveyor means 46 of the waiting mechanism 3, viz., to move toward and away from the surface of each of the shelves 67 on the book truck 4. The movable frame 47 carries thereon a plurality of parallel spaced rotary shafts 49 at substantially right angles with respect to the conveyance direction of the tread member T. Each of the rotary shafts 49 carries thereon a multiplicity of generally circular disc members 50 which are rigidly secured thereto parallel to and in spaced relation with each other and a sprocket wheel which is also rigidly mounted on the end portion thereof but not shown in the drawings. The movable frame 47, the rotary shafts 49 and the circular disc members 50 constitute, as a whole, loading conveyor means 52. The movable frame 47 is connected at its rear end to a carrier member 55 which has two pairs of wheels 53 rested on a pair of parallel spaced rail members 54 which are horizontally fixedly mounted on the fixed frames 28 and 48. A fluid-operated cylinder 56 is horizontally supported on the fixed frame 28 and has a piston rod **56*a* the forward end of which is connected to the rear end of the movable frame 47 of the loading mechanism 5 so that when the fluid-operated cylinder 56 is actuated to forwardly project or backwardly retract the piston rod 56*a*, the movable frame 47 is caused to move forwardly or backwardly through the carrier member 55. A sprocket wheel 57 which is supported on the upper portion of the fixed frame 48 and sprocket wheels which are rotatably mounted on the respective rotary shafts 49 but not shown in the drawings are passed on with an endless chain 58 which is on the other hand passed on a sprocket wheel 57'. The sprocket wheel 57' is rotatably mounted on a bracket 55*a* vertically extending out of the rear end upper surface of the carrier member 55 and has a one-way clutch therein. The sprocket wheel 57 is driven in rotation by an electric motor 59 through a sprocket wheel 60 rigidly mounted on an output shaft of the electric motor 59, an endless chain 61 passed on the sprocket wheel 60, and an electromagnetic clutch brake 63 having an input shaft carrying thereon a sprocket wheel 62 passed on with the endless chain 61 and an output shaft fixedly connected to the outermost rotary shaft 49**.

The book truck 4 has a plurality of shelves 67 piled thereon and is vertically moved by a table lifter 68 which is adapted to intermittently lower by a pitch substantially equal to the thickness of the shelf 67 when the tread members T are loaded on the shelf 67 and to upwardly move to resume an uppermost initial position prior to their loading for transferring the tread members T to a following process when the loading for the predetermined number of tread members T is completed.

The operation to load the tread members T onto the shelves 67 by the apparatus thus constructed and arranged will now be described with reference to FIGS. 3 and 4.

Figure 2:
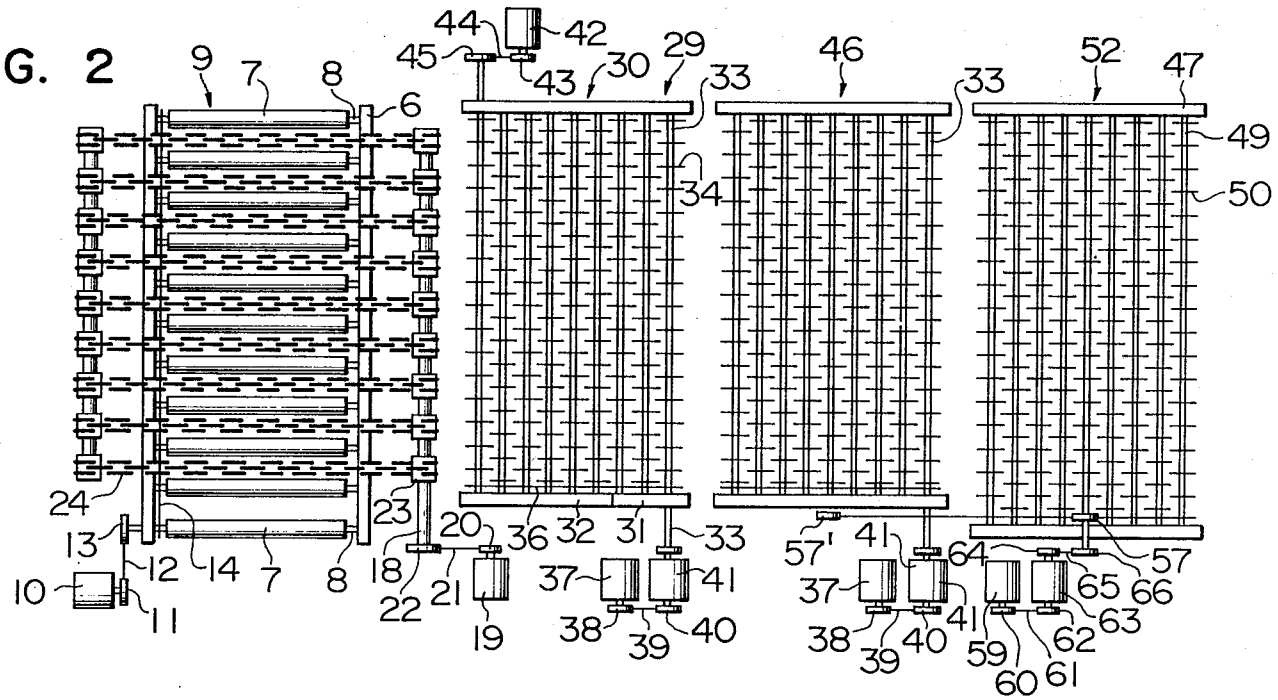
FIG. 2 is a plan view of the embodiment illustrated in FIG. 1 but not showing the book truck.
Figure 3:
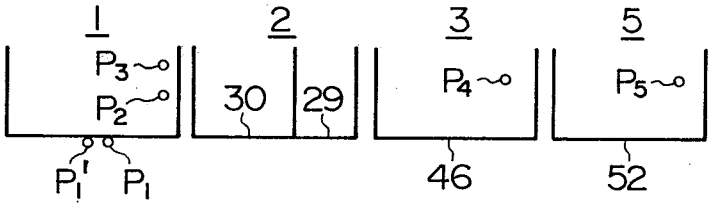
FIG. 3 is a schematic view of the embodiment showing arrangement of photoelectric tubes for actuating the embodiment.
Figures 4A, 4B, 4C, 4D, 4E, 4F, 4G, 4H, 4I:
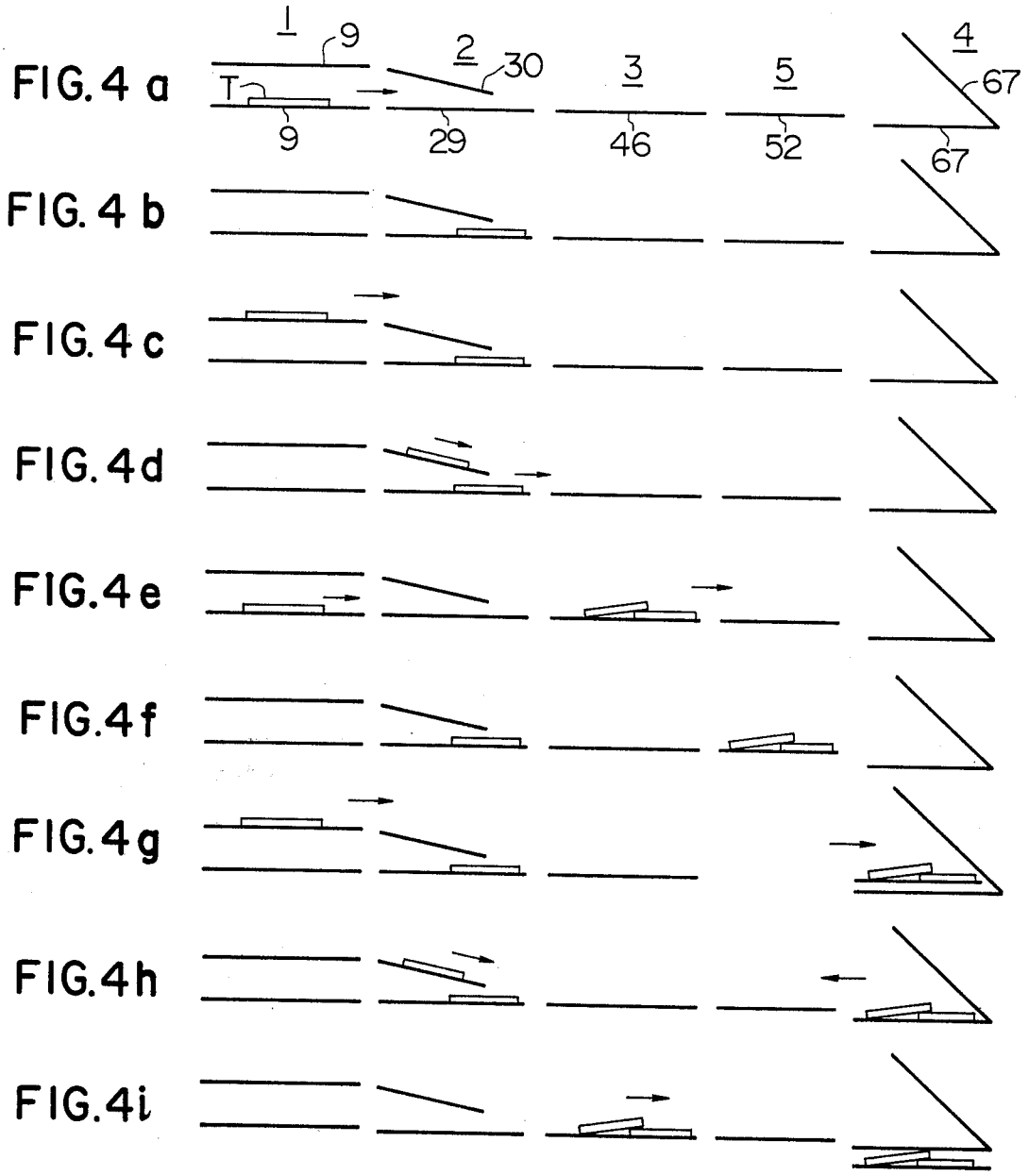
FIG. 4*a* to 4*i* are schematic side elevational views for explanation of the tread members from their conditions in which they are conveyed to the turning mechanism to their conditions in which they are conveyed and loaded on the shelves on the book truck.
Figure 5:
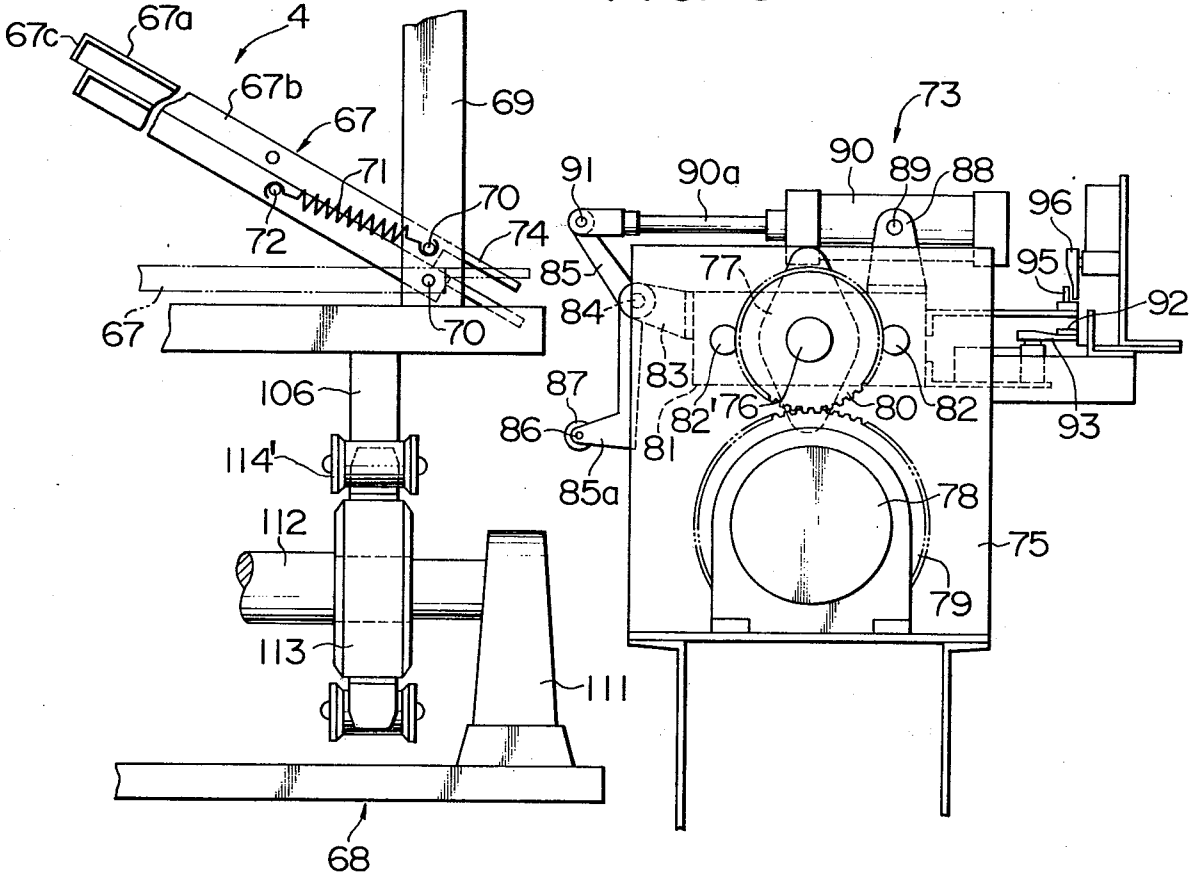
FIG. 5 is an enlarged side elevational view of a swing mechanism in the preferred embodiment of the present invention.

When a photoelectric tube P1' located at the forward end of the first turning means 9' of the turning mechanism 1 as shown in FIG. 3 detects the forward side of the tread member T which is conveyed by the turning means 9' as shown in FIG. **4*a*, the fluid-operated cylinder 17' is actuated to upwardly project the piston rod 17*a'* so that the movable frame 16' is caused to move upwardly to lift the upper surfaces of the endless chains 24' beyond the upper surfaces of the rollers 7' as shown in phantom lines in FIG. 1. At this time, the tread member T is conveyed from the first turning means 9' to the first conveyor means 29 of the lining-up mechanism 2 after being turned in the conveyance direction at substantially right angles. Immediately after this, the fluid-operated cylinder 17'** is actuated to cause the piston rod 17*a'* to be retracted downwardly so that the movable frame 16' and the chains 24' are downwardly moved to resume their initial positions as shown in solid lines in FIG. 1. When predetermined times have passed after a photoelectric tube P2 located at the forward side of the first turning means 9' opposite to the first conveyor means 29' of the lining-up mechanism 2 as shown in FIG. 3 then detects the forward side of the tread member T, the electromagnetic clutch brake 41 of the first conveyor means 29 is actuated to cause its brake to be operated so that the first conveyor means 29 is stopped, whereupon the tread member T is positioned at the forward end portion of the conveyor means 29 as shown in FIG. 4*b*. When a photoelectric tube P1 located at the forward end of the second turning means 9 of the turning mechanism 1 as shown in FIG. 3 detects the forward end of the tread member T which is conveyed by the turning means 9 as shown in FIG. 4*c*, the fluid-operated cylinder 17 is actuated to upwardly project the piston rod 17*a* so that the movable frame 16 is caused to move upwardly to lift the upper surfaces of the endless chains 24 beyond the upper surfaces of the rollers 7 as shown in phantom lines in FIG. 1. At this time, the tread member T is conveyed from the second turning means 9 to the second conveyor means 30 of the lining-up mechanism 2, after being turned in the conveyance direction at substantially right angles, as shown in FIG. 4*d*. Immediately after this, the fluid-operated cylinder 17 is actuated to cause the piston rod 17*a* to be retracted downwardly so that the movable frame 16 and the chains 24 are moved to resume their initial positions as shown in solid lines in FIG. 1. When predetermined times have passed after a photoelectric tube P3 located at the forward side of the second turning means 9 opposite to the second conveyor means 30 of the lining-up mechanism 2 as shown in FIG. 3 then detects the backward side of the tread member T, the electromagnetic clutch brake 41 of the first conveyor means is actuated to cause the first conveyor means 29 driven with its brake deactuated and the tread member T is so moved at a predetermined distance that the tread member T on the second conveyor means 30 may partially be overlapped on the tread member T on the first conveyor means 29. At this time, these partially overlapped tread members T are conveyed onto the waiting conveyor means 46 of the waiting mechanism 3 while being maintained under a lining-up condition as shown in FIG. 4*e*. When a suitable detector such as a photoelectric tube not shown in the drawings then detects no tread member T on the loading conveyor means 52 of the loading mechanism 5 as shown in FIG. 4*e*, the electromagnetic clutch brake 41 is actuated to cause the waiting mechanism 3 to be driven so that the tread members T are directly conveyed onto the loading conveyor means 52 of the loading mechanism 5 which is positioned in close proximity to the forward end of the waiting conveyor means 46. When predetermined times have passed after a photoelectric tube P5 located at the forward end portion of the loading mechanism 5 then detects the forward side of the tread members T, the electromagnetic clutch brake 63 of the loading mechanism 5 is actuated to cause the loading conveyor means 52 to be stopped so that the tread members T are stopped at the forward end of the loading conveyor means 52 as shown in FIG. 5. On the other hand, when predetermined times have passed after the previously described detector detects the tread members T present on the loading conveyor means 52 and a photoelectric tube P4 located at the forward end of the waiting conveyor 46 detects the forward side of the tread members T, the electromagnetic clutch brake 41 is actuated to cause the waiting conveyor means 46 to be stopped with its brake actuated until the tread members T on the loading conveyor means 52 are loaded onto the shelf 67 on the book truck 4. When a suitable detector such as a photoelectric tube not shown in the drawings then detects no tread members T on the uppermost horizontal shelf 67 of the book truck 4, the electromagnetic clutch brake 63 is actuated to cause its brake to be deactuated while the fluid-operated cylinder 56 is actuated to cause the piston rod 56*a* to be projected forwardly so that the loading conveyor means 52 is moved along the rail members 54 until the forward end portion of the loading conveyor means 52 is moved onto the uppermost horizontal shelf 67 as shown in FIG. 4*h*. At this time, the tread members T on the loading conveyor means 52 are not moved relatively to the loading conveyor means 52 by the action of the one-way clutch in the sprocket wheel 57'. When the fluid-operated cylinder 56 is actuated to cause the piston rod 56*a* to be retracted backwardly so that the loading conveyor means 52 is moved away from the uppermost horizontal shelf 67 and toward the waiting conveyor means 46 of the waiting mechanism 3 until it resumes the initial position as shon in FIG. 4*h* while the electromagnetic clutch brake 63 is actuated to cause its brake to be actuated, whereupon the rotary shafts 49 and the disc members 50 are rotated through the endless chain 58 by the action of the brake of the electromagnetic clutch brake 63 and the one-way clutch in the sprocket wheel 57*a* since the endless chain 58 is fixed at a point on a sprocket wheel 57. At this time, the difference between the rotation speed of the disc members 50 and the movement speed of the loading conveyor means 52 becomes zero so that the tread members T will be loaded on the uppermost horizontal shelf 67 without horizontal movement. When the tread members T are loaded as such and detected by the previously described detector, the table lifter 68 is actuated be lowered by the thickness of the shelf 67 as shown in FIG. 4*i*.

The tread members T may be loaded on the shelf 67 after being spaced apart from each other with a predetermined spacing and lined up on the lining mechanism 2 by increasing the speed of the first conveyor means 29 of the lining mechanism 2 in place of their overlapping previously described.

Figure 6:
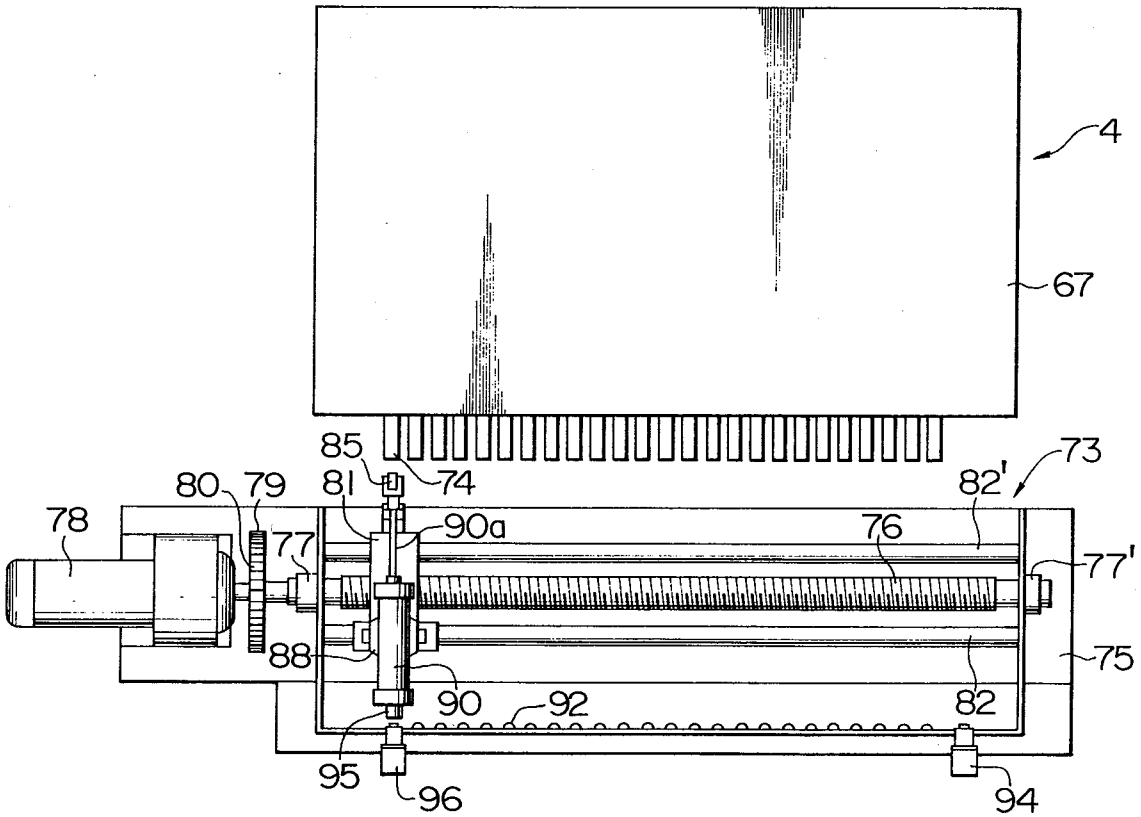
FIG. 6 is a reduced plan view of the swing mechanism illustrated in FIG. 5.

In FIGS. 5 and 6, the book truck 4 having thereon a plurality of shelves 67 is mounted on a table lifter 68 which is adapted to intermittently lower by a pitch substantially equal to the height of each of the shelves 67. The shelves 67 are constructed to have a substantially identical configuration and each shelf 67 comprises a plain rectangular plate 67*a*, a pair of downwardly extending side plates 67*b* made integral with the opposite sides of the plate 67*a*, and downwardly extending front plate 67*c* made integral with the front end of the rectangular plate 67*a*. The shelves 67 are pivotally mounted on a pair of parallel spaced upstanding supports 69 on the book truck 4 by means of respective horizontal pivotal pins 70. Each of the shelves 67 has a coil spring 71 one end of which is connected to a secure pin 72 fixedly mounted on a longitudinally intermediate portion of each of the side plates 67*b* and the other end of which connected to the immediately upper pivotal pin 70 so that the shelf 67 is urged to swing toward a vertical line. The shelves 67 are prevented from further swinging by means of a stop pin, not shown, to be held in their respective slanted positions when the sheet materials are not loaded on the shelves 67 as particularly shown in FIG. 5. When the lowest slanted shelf 67 is downwardly urged to swing about the pivotal pin 70 over its dead angle by means of a swing mechanism as will be hereinafter described in detail, the shelf 67 is swung by gravity to be in a horizontal position as shown in phantom lines. The spring constant of the coil spring 71 is defined with respect to the empty weight of the shelf 67. The coil springs and the stop pin which serve to resiliently hold the shelves 67 under slanted conditions may be replaced by any other means such as, for example, a pair of flat or leaf springs which are disposed to urge the both side plates 67*b* of each of the shelves 67 so that the shelves 67 are resiliently held under slanted conditions.

A swing mechanism 73 is disposed oppositely to and in the vicinity of the rear surface of the book truck 4. The shelves 67 have respective projections 74 at the rear ends thereof opposite to the swing mechanism 73, the projections 74 being steppedly arranged from the topmost left side to the topmost right side and being equidistantly spaced apart from each other. The frame structure 75 of the swing mechanism 73 is disposed oppositely to and along the projections 74 of the shelves 67. A drive screw shaft 76 is horizontally disposed opposite to the projections 74 and has both ends which are rotatably mounted on the frame structure 75 through bearings 77 and 77'. The drive screw shaft 76 is rotated by an electric motor 78 through a spur gear 79 secured on an output shaft of the electric motor 78 and a spur gear 80 which is meshed with the spur gear 79 and rigidly connected to the drive screw shaft 76. A travelling carrier 81 is provided in threaded engagement with the drive screw shaft 76 and slidably engaged with a pair of guide rods 82 and 82' which are rigidly mounted on the frame structure 75 in parallel with the drive screw shaft 76 to guide the travelling carrier 81 along the projections 74 of the shelves 67. The travelling carrier 81 carries at its front face opposite to the projections 74 a bracket 83 which rotatably supports a swing lever 85 through a pivotal pin 84. The swing lever 85 is formed at its lower portion with a projection 85*a* projected toward the book truck 4 and rotatably carrying a roller 87 through a pivotal pin 86. The swing lever 85 is pivotally connected at its upper end through a pivotal pin 91 to the forward end of a piston rod 90*a* of a fluid-operated cylinder 90 which is pivotally supported by a pair of brackets 88 through a pivotal pin 89. The brackets 88, one of which is only illustrated, are secured to the upper face of the travelling carrier 81. When the fluid-operated cylinder 90 is actuated to cause the piston rod 90*a* to be retracted backwardly, the swing lever 85 is swung clockwise in FIG. 5 about the pivotal pin 84 to urge upwardly each of the projections 74 by the roller 87 so that each of the shelves 67 is urged to downwardly swing against each of the coil springs 71 over its dead angle and then swung by gravity to be in a horizontal position as shown in phantom lines. A plurality of stop switch elements 92 are disposed in alignment with the respective projections 74 of the shelves 67 on the inner wall of the frame structure 74 to produce respective signals for stopping the electric motor 78 to stop the travelling carrier 81 when an actuator 95 provided on the rear face of the travelling carrier 81 is brought into contact with the stop switch elements 92. The swing lever 85 is thus brought into alignment with each of the projections 74 of the shelves 67 prior to each of their swinging-down operations. A reverse switch element 94 is provided at the rightmost position of the inner wall of the frame structure 75 to produce a signal for reversely rotating the electric motor 78 to return the travelling carrier 81 to its initial position when the actuator 95 is brought into contact with the reverse switch element 94. A stop switch element 96 is provided at the leftmost position of the inner wall of the frame structure 75 to produce a signal for stopping the electric motor 78 to stop the travelling carrier 81 at its initial position when the actuator 95 is brought into contact with the stop switch element 96.

When the tread members T are loaded on the horizontal uppermost shelf 67 by the loading mechanism 5 as shown in FIG. 1, the detector, previously described, detects the tread members T on the shelf 67 to lower the table lifter 68 by a pitch. The fluid-operated cylinder 90 is then actuated to cause the piston rod 90*a* to be retracted backwardly so that the swing lever 85 is swung clockwise in FIG. 5 about the pivotal pin 84 to upwardly urge the projection 74 of the shelf 67 and thus to lower the shelf 67 to its horizontal position. The fluid-operated cylinder 90 is thereafter actuated to cause the piston rod 90*a* to be projected forwardly so that the swing lever 85 is swung counterclockwise about the pivotal pin 84 to resume the original position as shown in solid lines. When the next tread members T are loaded on the shelf 67 which has just been swung to its horizontal position, the detector similarly detects the tread members T to lower the table lifter 68 by a further pitch and to rotate the electric motor 78 so that the travelling carrier 81 is caused to travel along the book truck 4 through the drive screw shaft 76 from its initial position as shown in solid lines in FIG. 6. When the actuator 95 on the travelling carrier 81 is brought into contact with the next stop switch element 92, the electric motor 78 is stopped to cause the travelling carrier 81 stopped so that the swing lever 85 is held in alignment with the projection 74 of the immediately upper shelf or the lowermost slanted shelf 67 which is then lowered by the swing lever 85 by the action of the fluid-operated cylinder 90 in a similar fashion to that previously described. The shelves 67 are continuously loaded with the tread members T in the above loading operation. When the actuator 95 is then brought into contact with the reverse switch element 94, the electric motor 78 is reversely rotated to return the travelling carrier 81 toward its initial position. When the actuator 95 is finally brought into contact with the stop switch element 96; the electric motor 78 is stopped to cause the travelling carrier 81 to be stopped at the initial position.

Figure 7:
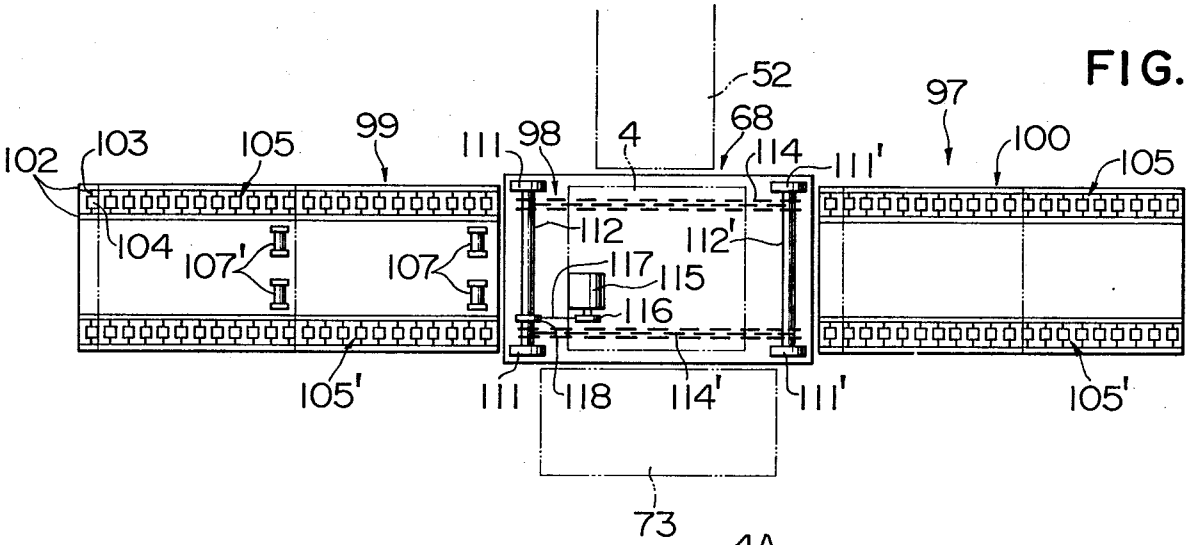
FIG. 7 is a plan view of a truck conveyor mechanism in the preferred embodiment of the present invention.
Figure 8:
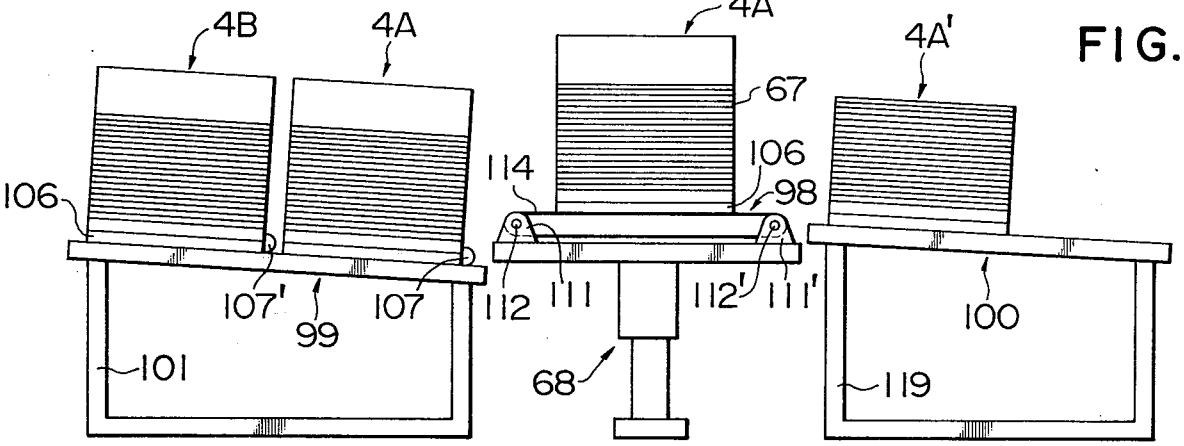
FIG. 8 is a side elevational view of the truck conveyor mechanism illustrated in FIG. 7.

In FIGS. 7 and 8, a truck conveyor mechanism 97 is provided opposite to the loading mechanism 5 and comprises a central truck conveyor mechanism 98 provided on the table lifter 68, a slanted truck feeding conveyor mechanism 99 diposed adjacent to one side of the central truck conveyor mechanism 98 for feeding an empty book truck 4 with no tread member T onto the central truck conveyor mechanism 98 and a slanted truck discharging mechanism 100 disposed adjacent to the other side of the central truck conveyor mechanism 98 for discharging a full book truck 4 fully loaded with tread members T out of the central truck conveyor mechanism 98. The truck feeding conveyor mechanism 99 is supported on a fixed frame structure 101 such that the forward end of the truck feeding conveyor mechanism 99 opposite to the central truck conveyor mechanism 98 is lower than the rear end thereof remote from the central truck conveyor mechanism 98. The truck feeding conveyor mechanism 99 has both upper side portions, each of which is provided with a pair of longitudinally extending parallel spaced support plates 102 which carry thereon a multiplicity of free rollers 104 through respective rotary shafts 103, disposed at substantially right angles with respect to the conveyance direction of the book truck 4. The free rollers 104 thus constitute as a whole a pair of roller conveyors 105 and 105' which support a pair of parallel spaced legs 106 projected downwardly out of the bottom wall of the book truck 4. In order to stop a first empty book truck 4A which slides down by gravity on the slanted roller conveyors 105 and 105', a pair of first truck stop means 107 are provided opposingly to each other between the above two roller conveyors 105 and 105' at the forward end portion of the truck feeding conveyor mechanism 99 on the fixed frame structure 101. For a similar reason, a pair of second truck stop means 107' are provided opposingly to each other between the above two roller conveyors 105 and 105' at the longitudinally intermediate portion of the truck feeding conveyor mechanism 99 on the fixed frame structure 101 for stopping the second empty book truck 4B in a condition held spaced apart from and behind the first empty book truck 4A at a predetermined distance. The second truck stop means 107' has substantially the same construction as that of the first truck stop means 107 one of which comprises a pair of brackets 108 fixedly mounted at the inner side of the roller conveyor 105' on the fixed frame structure 101 to be spaced apart from each other, a fluid-operated cylinder 109 fixedly mounted on the brackets 108 and having a piston rod **109*a* extending toward a space above the roller conveyor 105' and a guide member 110 fixedly mounted on the inner support plate 102 to be disposed forwardly of the piston rod 109*a* and having a bore 110*a* for slidably receiving the piston rod 109*a* as shown in FIG. 9. The other of the first truck stop means 107 is provided at the inner side of the roller conveyor 105 and has substantially the same construction to the previously described one of the first truck stop means 107. When the fluid-operated cylinders 109 of the first truck stop means 107 thus arranged are actuated to cause the piston rods 109*a* to be projected forwardly through the bores 110*a* of the guide members 110, the forward end portions of the piston rods 109*a* are moved to the spaces above the roller conveyors 105 and 105' so that the legs 106 of the book truck 4 are engaged with the forward end portions of the piston rods 109*a* to stop the book truck 4 at the forward end portion of the truck feeding conveyor mechanism 99. Similarly, the fluid-operated cylinders 109 of the second truck stop means 107' stop the book truck 4 at the longitudinally intermediate portion of the truck feeding conveyor mechanism 99. The central truck conveyor mechanism 98 includes a pair of rotary shafts 112 and 112' which are disposed in parallel with and spaced apart from each other at both end portions thereof opposite to the truck feeding mechanism 99 and the truck discharging mechanism 100 and which are rotatably supported at both ends thereof by their respective brackets 111 and 111', and a pair of endless chains 114 and 114' which are passed on sprocket wheels 113 securely mounted on the rotary shafts 112 and 112', only one being shown in FIG. 5, and which are respectively in alignment with the roller conveyors 105 and 105'. The endless chains 114 and 114' are driven by an electric motor 115 mounted on the table lifter 68 through a sprocket wheel 116 securely mounted on an output shaft of the electric motor 115, a sprocket wheel 118 securely mounted on the rotary shaft 112 and an endless chain 117 passed on the sprocket wheels 116 and 118. The endless chains 114 and 114' thus serve to receive the empty book truck 4 sliding down on the roller conveyors 105 and 105' of the truck feeding conveyor mechanism 99 when the table lifter 68 is held at a lower level and to discharge the full book truck 4 onto the truck discharging conveyor mechanism 100 when the table lifter 68 is held at a higher level. The truck discharging conveyor mechanism 100 is supported on a fixed frame structure 119 such that the forward end of the truck discharging conveyor mechanism 100 is lower than the rear end thereof opposite to the central truck conveyor mechanism 98. The truck discharging conveyor mechanism 100 is substantially the same as the truck feeding conveyor mechanism 99 in construction with the exception that the truck discharging conveyor mechanism 100 has neither first truck stop means 107 nor second truck stop means 107' which are previously described so that the full book truck 4 spontaneously slides down by gravity to the forward end of the truck discharging conveyor mechanism 100 when it is transferred onto the truck discharging conveyor mechanism 100 from the table lifter 68**.

In FIGS. 7 to 9, when the empty book truck 4A having the shelves 67 held opened at a suitable angle is mounted on the roller conveyors 105 and 105' of the truck feeding conveyor mechanism 99, it spontaneously slides down by gravity toward the forward end of the roller conveyors 105 and 105'. In this instance, the empty book truck 4A is allowed to slide down toward the forward end of the roller conveyors 105 and 105' when any empty truck 4A is not present between the first and second stop means 107 and 107' on the forward half portion of the truck feeding conveyor mechanism 99. The fact that no empty truck 4A is present therebetween is detected by a suitable detector, not shown in the drawings, which produces a signal to cause the piston rods **109*a* of the fluid-operated cylinders 109 of the first truck stop means 107 to be retracted backwardly away from the spaces above the roller conveyor 105 and 105'. When the detector then detects passing of the empty truck 4A between the first and second stop means 107 and 107' on the forward half portion of the truck feeding conveyor mechanism 99, the fluid-operated cylinders 109 of the first truck stop means 107 are actuated to cause the piston rods 109*a* projected forwardly to the spaces above the roller conveyors 105 and 105' so that the book truck 4A is stopped at the forward half portion of the truck feeding conveyor mechanism 99 with the legs 106 of the book truck 4A being engaged with the piston rods 109*a* of the fluid-operated cylinders 109. The fluid-operated cylinders 109 of the second truck stop means 107' are simultaneously actuated to cause the piston rods 109*a* to be projected forwardly to the spaces above the roller conveyors 105 and 105' in a similar manner so that a book truck 4B is stopped at the rear half portion of the truck feeding conveyor mechanism 99 to be spaced backwardly of the previously mounted book truck 4A when the book truck 4B is mounted on the roller conveyors 105 and 105' in the same fashion as mentioned above. The table lifter 68 is then actuated to be lowered until the endless chains 114 and 114' of the central truck conveyor mechanism 98 are brought to the same level as the forward ends of the conveyor rollers 105 and 105'. After the downward movement of the table lifters 68, the fluid-operated cylinders 109 of the first and second truck means 107 and 107' are simultaneously actuated to cause the piston rods 109***a* to be retracted backwardly so that the legs 106 of the empty book trucks 4A and 4B are disengaged from the piston rods 109*a*. The book truck 4A is consequently allowed to slide down on the roller conveyors 105 and 105' until the legs 106 of the book truck 4A come to be in pressing contact with the endless chains 114 and 114' of the central truck conveyor mechanism 98 while being pushed by the book truck 4B. On the other hand, book truck 4B is similarly allowed to slide down on the roller conveyors 105 and 105' toward the forward half portion of the truck feeding conveyor mechanism 99 while being pushed by another rear book truck, not shown in FIG. 8. When the detector then detects the book truck 4B passing through the forward half portion of the truck feeding conveyor mechanism 99, the fluid-operated cylinders 109 of the first and second truck stop means 107 and 107' are similarly simultaneously actuated to stop the book truck 4B at the forward half portion of the truck feeding conveyor mechanism 99. As the legs 106 of the book truck 4A come to be in pressing contact with the endless chains 114 and 114' of the central truck conveyor mechanism 98, the book truck 4A is conveyed and stopped at a predetermined position by means of the endless chains 114 and 114' which are driven by the electric motor 115 through the sprocket wheel 116, the endless chain 117, the sprocket wheel 118, the rotary shafts 112 and 112' and the sprocket wheels 113. Under these conditions, the tread members T are completely loaded by the previously explained loading mechanism 5 onto all the shelves 67 of the book trucks 4*a* and the table lifter 68 is thereafter again lifted until the endless chains 114 and 114' of the central truck conveyor mechanism 98 are brought to the same level to the roller conveyors 105 and 105' of the truck discharging conveyor mechanism 100. The endless chains 114 and 114' are driven by the electric motor 115 to convey onto the roller conveyors 105 and 105' of the truck discharging conveyor mechanism 100 the full book trucks 4A which thereafter slides down by gravity on the roller conveyors 105 and 105'. When the full book truck 4A starts sliding-down, the electric motor 115 is stopped so as not to drive the endless chains 114 and 114'. The table lifter 68 is then actuated to be lowered in preparation for the following operation until the endless chains 114 and 114' are similarly brought to the same level to the forward ends of the conveyor rollers 105 and 105' of the truck feeding conveyor mechanism 99. It is to be understood that the empty book trucks 4 are continuously conveyed to the position on the central truck conveyor mechanism 98 from the truck feeding conveyor mechanism 99 and the full book truck 4 are continuously discharged onto the truck discharging conveyor mechanism 100.

The swing mechanism 73 which is previously described in FIG. 5 and 6 may be replaced by a swing mechanism 168 which will be hereinafter described in detail. The swing mechanism 168 is shown comprising a fixed frame 169 provided above and forwardly of the shelves 67 of the book truck 4 and a fluid-operated rotary cylinder 170 connected to the fixed frame 169 and having a rotary shaft 171. The first fluid-operated cylinder 172 connected at its rear end to the rotary shaft 171 of the rotary cylinder 170 and has a piston rod 174 which slidably receives a sliding member 173 thereon. A second fluid-operated cylinder 175 has a rear end which is pivotally connected to a bracket 177 securely mounted on the forward end of the first fluid-operated cylinder 172 through a pivotal pin 176 and a piston rod 175*a* the forward end of which is pivotally connected to a bracket 178 fixedly mounted on the rear end of the sliding member 173 through a pivotal pin 179. The sliding member 173 has a forward upper end which fixedly supports a protrusion 180 forwardly extending to be engageable with the front plates 67*c* of the shelves 67 and a forward lower end which fixedly supports bracket 183. An L-shaped swing lever 181 has one end pivotally connected to the forward end of the bracket 183 through a pivotal pin 182 and the other end connected to an arcuate lever 184. A third fluid-operated cylinder 189 has a rear end which is pivotally connected to a bracket 185 securely mounted on the rear end of the sliding member 173 through a pivotal pin 186 and a piston rod 187 the forward end of which is pivotally connected to a curved intermediate portion of the swing lever 181 through a pivotal pin 188.

Figures 11A, 11B, 11C, 11D, 11E:
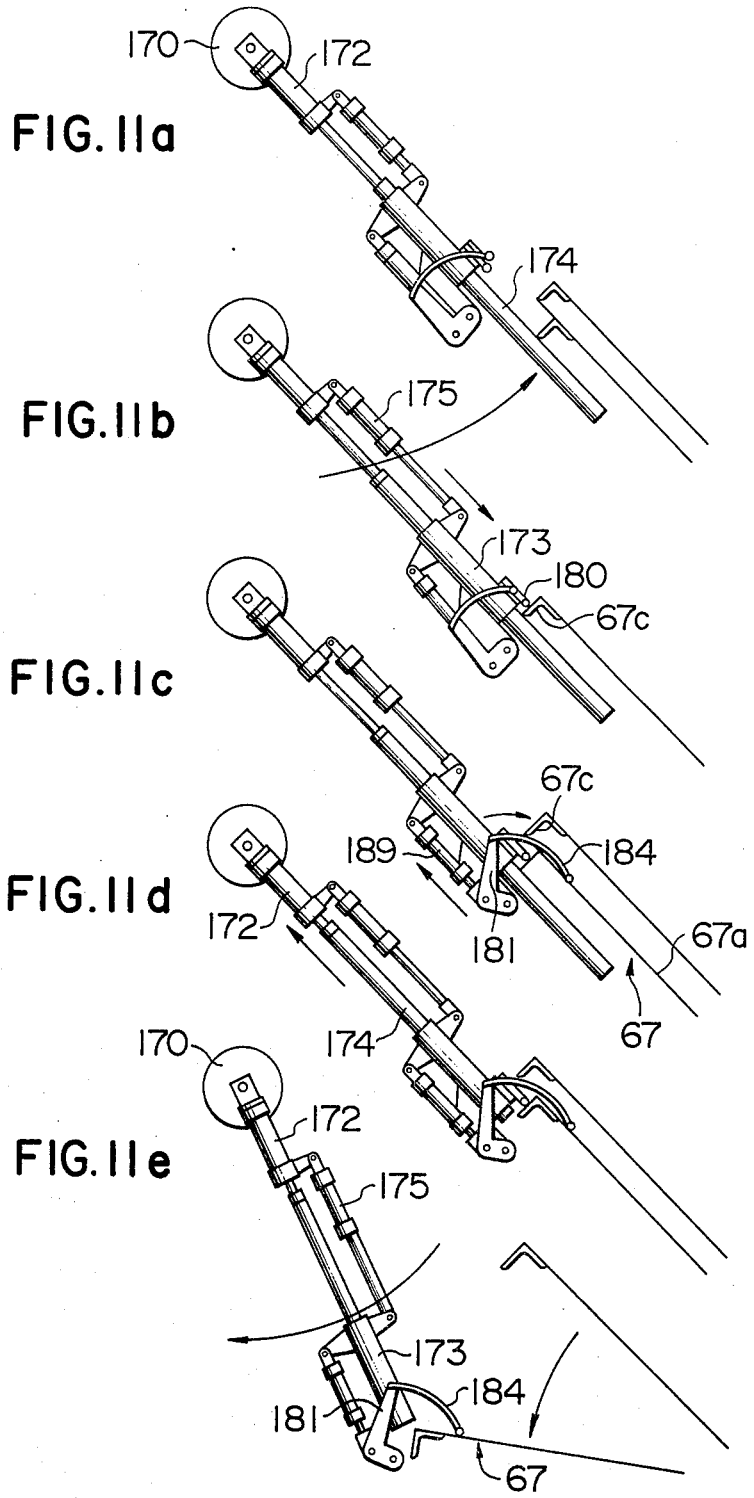
FIGS. 11*a* to 11*e* is side elevational views for explaining actuation stages of the swing mechanism illustrated in FIG. 10.

When the swing mechanism 168 is vertically held as shown in phantom lines in FIG. 10, the first fluid-operated cylinder 172 is maintained in a condition having the piston rod 174 kept forwardly projected while the second fluid-operated cylinder 175 is maintained in a condition having the piston rod 175*a* kept backwardly retracted so that the sliding member 173 is held in a position closest from the forward end of the first fluid-operated cylinder 172. The fluid-operated cylinder 189 is also maintained in a condition having a piston rod 187 kept projected forwardly so that the L-shaped swing lever 181 and the arcuate lever 184 are held in their respective positions as shown in FIGS. 11*a* and 11*b*. Under these conditions, the rotary cylinder 170 is then actuated to cause the first fluid-operated cylinder 172 to be rotated until the forward end portion of the piston rod 174 of the first fluid-operated cylinder 172 is engaged with the lower edge of the front plate 67*c* of the lowest slanted shelf 67 by the action of the previously described detector which detects the tread member T loaded on the uppermost horizontal shelf 67 as shown in FIG. 11*a*. The second fluid-operated cylinder 175 is then actuated to cause the piston rod 175*a* to be projected forwardly and thus to slide the sliding member 173 toward the forward end of the piston rod 174 until the protrusion 180 is engaged with the front plate 67*c* of the lowest slanted shelf 67 as shown in FIG. 11*b*. When the fluid-operated cylinder 189 is then actuated to cause the piston rod 187 to be retracted backwardly, the swing lever 181 is turned about the pivotal pin 182 clockwise in FIGS. 10 and 11 so that the arcuate lever 184 is inserted through a space formed between the front plates 67*c* of the slanted shelves 67 overlapped to each other until the forward end of the arcuate lever 184 is engaged with the rectangular plate 67*a* as shown in FIGS. 10 and 11*c*. The first fluid-operated cylinder 172 is then actuated to cause the piston rod 174 to be retracted backwardly as shown in FIG. 11*d* while the rotary cylinder 170 is actuated to cause the first fluid-operated cylinder 172 to be rotated toward a vertical line as shown in FIGS. 11*c*, 11*d* and 11*e* so that the lowest slanted shelf 67 is swung to overlap on the uppermost horizontal shelf 67 on the book truck 4. The sliding member 173 is then restored to its initial position by the action of the second fluid-operated cylinder 175 while the swing lever 181 and the arcuate lever 184 are restored to their initial positions by the action of the third fluid-operated cylinder 189. The table lifter 68 is then lowered by a pitch to await the next loading operation by the loading mechanism 5 and thus to complete a single cycle of swinging operation of the shelf 67. A number of such cycles are repeated after the loading operation by the loading mechanism 5.

Although the shelves 67 have been described as having a pair of side plates 67*b* and a front plate 67*c*, they are not limited to the above construction and may have any construction if the protrusion 180 is engaged with the outer edge of each of the shelves 67 and the arcuate lever 181 is inserted into the space formed between the slanted shelves 67. The arcuate lever 181 may be engaged with the side upper surface of each of the shelves 67 in place of its front upper surface as mentioned above, if desired. The book truck 4 may have at least two pairs of wheels at its legs and be mounted directly on the table lifter 68.

From the foregoing description, it will now be seen that the sheet materials are loaded on a plurality of shelves on the book truck in automated fashion resulting in increased production efficiency and contributing to elimination of laborious operations. The deformation of the tread member will be prevented during its handling and the tire characteristics for a finished tire are thus extremely enhanced.

The detailed description of the preferred embodiment of the invention for the purpose of explaining the principles thereof is not to be considered as limiting or restricting the invention, as many modifications may be made by the exercise of skill in the art without departing from the scope and spirit of the invention.

What is claimed is:

1. An apparatus for loading sheet materials on a plurality of shelves piled on a book truck comprising:

a loading mechanism including conveyor means movable toward and away from the upper surface of each of said shelves on said truck, actuator means for moving said conveyor means toward and away from the upper surface of each of said shelves, and a driving unit including an endless member for drivable engagement with said conveyor means, a drive source for driving said endless member, a one-way clutch member passed on by said endless member, and a movable frame connected to said conveyor means and supporting said clutch member so that when said conveyor means is moved away from the upper surface of each of said shelves by said actuator means, said drive source is not driven and said one-way clutch member is disengaged to drive said conveyor means relatively to said sheet materials to transfer said sheet materials onto each of said shelves and when said conveyor means is moved toward the upper surface of each of said shelves by said actuator means, said drive source is driven and said one-way clutch member is engaged so as not to drive said conveyor means relative to said sheet materials;

a waiting mechanism adjacent an end of said loading mechanism remote from said book truck for conveying said sheet materials onto said loading mechanism when said loading mechanism has no sheet material thereon and for holding said sheet materials thereon when said loading mechanism has said sheet materials thereon; and a lining-up mechanism adjacent an end of said waiting mechanism remote from said loading mechanism for lining up said sheet materials and conveying said sheet materials onto said waiting mechanism.

2. An apparatus as set forth in claim 1, which further comprises a turning mechanism adjacent to an end of said lining-up mechanism remote from said waiting mechanism for turning the conveyance direction of each of said sheet materials to be received on said lining-up mechanism.

3. An apparatus as set forth in claim 1, in which said waiting mechanism includes conveyor means for conveying said sheet materials onto said loading means, a driving unit for driving said conveyor means, and detecting means for detecting said sheet materials on said loading mechanism to provide a signal to said driving unit so that the conveyor means is driven when said loading mechanism has no sheet material thereon and the conveyor means is not driven when said loading mechanism has said sheet materials thereon.

4. An apparatus as set forth in claim 1, in which said lining-up mechanism includes first conveyor means, a first driving unit for driving said first conveyor means, second conveyor means slanted with respect to the upper surface of said first conveyor means and having a foremost end positioned in close proximity of the surface of said first conveyor means, a second driving unit for driving said second conveyor means in unison with said first conveyor means for lining up said sheet material conveyed by said second conveyor means and said sheet material being conveyed on said first conveyor means so that two sheets of sheet material are conveyed onto said waiting mechanism in a lined-up condition.

5. An apparatus as set forth in claim 4, in which said turning mechanism includes first turning means adjacent to an end of the first conveyor means remote from said waiting mechanism to convey said sheet material onto said first conveyor means by turning the conveyance direction of said sheet material on said first turning means at substantially right angles and second turning means adjacent to an end of the second conveyor means remote from said waiting mechanism to convey said sheet material onto said second conveyor means by turning the conveyance direction of said sheet material on said second turning means at substantially right angles.

6. An apparatus as set forth in claim 5, in which each of said first and second turning means includes a fixed frame, a plurality of parallel roller members rotatably mounted on said fixed frame and spaced apart from each other, a roller member driving unit for driving said roller members to convey said sheet material on said roller members, a movable frame vertically movably mounted on said fixed frame, actuator means for vertically moving said movable frame, a pair of spaced parallel rotary shafts rotatably mounted on both ends of said movable frame and carrying thereon a pair of circular disc members between each two roller members, a rotary shaft driving unit for driving at least one of said rotary shafts, a plurality of endless members each of which is passed on each pair of said circular disc members to run at substantially right angles relative to the conveyance direction of said roller members so that when said actuator means is actuated to vertically move said movable frame upwardly, the upper surfaces of said endless members are moved upwardly over said roller members to transfer said sheet material on said roller members onto said endless members at substantially right angles for conveying said sheet material onto each of said first and second conveyor means of said lining-up mechanism.

7. An apparatus as set forth in claim 1, which further comprises a shelf detector for detecting no sheet material loaded on each of said shelves to produce a signal for actuating said actuator means to move said conveyor means toward the surface of each of said shelves.

8. An apparatus as set forth in claim 1, in which said shelves are pivotally mounted on said book truck and have respective projections projected outwardly to be steppedly arranged, and which further comprises holding means for resiliently holding said shelves in slanted condition, a swing mechanism disposed oppositely to and in the vicinity of said projections of said shelves for swinging down each of said shelves through said projections against said holding means to a horizontal condition from a slanted condition, a displacing mechanism for travelling said swing mechanism along said projections of said shelves to dispose said swing mechanism oppositely to each of said projections of said shelves, and a lifter mechanism for lowering each of said shelves on said book truck by a pitch substantially equal to the thickness of said shelf at a time.

9. An apparatus as set forth in claim 1, in which said shelves are pivotally mounted on said book truck, and which further comprises holding means for resiliently holding said shelves in slanted condition, a swing mechanism disposed oppositely to and in the vicinity of the outer edges of said shelves for detecting said outer edge of each of said shelves and swinging down each of said shelves against said holding means to a horizontal condition from a slanted condition, and a lifter mechanism for lowering each of said shelves on said book truck by a pitch substantially equal to the thickness of said shelf at a time.

10. An apparatus as set forth in claim 1, which further comprises a truck conveyor mechanism for mounting thereon said book truck during loading of said sheet materials and drivably conveying said book truck in and out of a predetermined position opposite to said loading mechanism, a lifter mechanism for lowering said book truck by a pitch substantially equal to the thickness of said shelf, a slanted truck feeding conveyor mechanism disposed adjacent to one side of said truck conveyor mechanism for feeding an empty truck onto said truck conveyor mechanism and a slanted truck discharging conveyor mechanism disposed adjacent to the other side of said truck conveyor mechanism for discharging a full truck out of said truck conveyor mechanism.

11. An apparatus as set forth in claim 10, in which at least one stop member is provided in said feeding mechanism for stopping said empty truck on said feeding mechanism when said truck is present on said truck conveyor mechanism.

* * * * *